US008413356B2

(12) United States Patent
Vaz

(10) Patent No.: US 8,413,356 B2
(45) Date of Patent: Apr. 9, 2013

(54) CANVAS STRETCHING SYSTEM WITH REUSABLE CORNER CLAMPS

(75) Inventor: Paul Vaz, Carlsbad Springs (CA)

(73) Assignee: Artex Picture Frames Ltd., Carlsbad Springs, Ontario (CA)

( * ) Notice: Subject to any disclaimer, the term of this patent is extended or adjusted under 35 U.S.C. 154(b) by 0 days.

(21) Appl. No.: 12/996,401

(22) PCT Filed: Jun. 9, 2008

(86) PCT No.: PCT/CA2008/001075

§ 371 (c)(1),
(2), (4) Date: Dec. 6, 2010

(87) PCT Pub. No.: WO2009/149532

PCT Pub. Date: Dec. 17, 2009

(65) Prior Publication Data

US 2011/0107627 A1 May 12, 2011

(51) Int. Cl.
*D06C 3/08* (2006.01)
*D06C 3/00* (2006.01)

(52) U.S. Cl.
USPC ..... 38/102.1; 38/102.91; 160/381

(58) Field of Classification Search ..... 160/378, 160/381; 40/603; 38/102.91, 102.1, 102.9
See application file for complete search history.

(56) References Cited

U.S. PATENT DOCUMENTS

| | | | | |
|---|---|---|---|---|
| 1,285,973 | A * | 11/1918 | Fredman | 160/380 |
| 2,028,353 | A * | 1/1936 | Roberts | 403/231 |
| 3,922,806 | A | 12/1975 | Saad | |
| 4,161,977 | A * | 7/1979 | Baslow | 160/381 |
| 4,860,467 | A | 8/1989 | Larson | |
| 5,133,140 | A | 7/1992 | Frey | |
| 5,136,797 | A | 8/1992 | Hildebrandt | |
| 5,579,595 | A * | 12/1996 | Dutton | 38/102.1 |
| 6,163,995 | A * | 12/2000 | Lucchetti et al. | 40/603 |
| 6,253,471 | B1 * | 7/2001 | Strauh | 38/102.1 |
| 8,122,624 | B2 * | 2/2012 | Vaz | 38/102.1 |
| 2006/0010729 | A1 | 1/2006 | Liu | |
| 2007/0295461 | A1 * | 12/2007 | Kim | 160/381 |

OTHER PUBLICATIONS

PCT Written Opinion of the International Searching Authority in PCT/CA2008/001075, dated Nov. 25, 2008.

* cited by examiner

*Primary Examiner* — Ismael Izaguirre
(74) *Attorney, Agent, or Firm* — Ostrager Chong Flaherty & Broitman P.C.

(57) ABSTRACT

A canvas or material stretching system designed to allow a professional or amateur user to stretch a canvas or material on a frame without the use of stretching pliers and staples, both of which require considerable skill and strength. Special purpose corner clamps are temporarily used to secure the stretcher bars into an initial open miter frame. The purpose of this is to orient the double sided adhesive strip on the side of the stretchers towards the canvas or material while maintaining the adhesive strip from touching the canvas or material. Once alignment is achieved, the stretching bars are pressed down and attached onto the canvas or material and the corners are released. The corner clamps are removed and canvas or material corners are cut and folded into the open miter ends which also have adhesive strips. By rotating the stretchers axially 90 degrees into the final frame, thus closing the miters, and upon inserting U-shaped fasteners into grooves placed on the back of the stretcher the canvas or material is stretched and ready to display.

6 Claims, 6 Drawing Sheets

(a)

(b)

SECTION AA (a)

(b)

SECTION B B

CANVAS STRETCHING SYSTEM WITH REUSABLE CORNER CLAMPS

BACKGROUND OF INVENTION

1. Field of Invention

This invention relates to frames that are used to mount and to provide tension for flexible fabrics, such as artist's canvasses, silk screen, digital photographs, and the like. In particular this invention relates to special purpose corner clamps that are reusable to enable the attachment of the canvas to the stretcher bars.

2. Description of the Related Art

Most prior art stretchers are manufactured as standard dimension lengths with machined ends. These lengths are assembled into frames with interlocking corners. The canvas or material is stretched on this frame using stretching pliers and with staples on the side. Wedges can be inserted into the interlocking corners to expand the frame and tension the canvas. Stretcher bars of this type have a few disadvantages: When first assembled the stretcher bars must be squared and aligned by the user or the diagonals will be off, making subsequent framing difficult or impossible.

The stretching of the material on the stretcher bars requires the use of specific tools like stretching pliers and staple guns, both of which are costly and might not be available in the average consumer's household.

When stretching the material with pliers it is very difficult to apply an even tension along every side of the material and this can cause undue stress on the stretcher bars, quite often causing the frame to warp and the material to wrinkle.

This stretching system requires a fair amount of skill, strength and practice in order to get good results. Thus it is intimidating and not user friendly.

In this type of stretching system, the staples are normally placed on the side of the stretcher bars which make the side edges of the material unsightly.

The corners of the material must be folded and fastened on the sides, adding bulk and detracting further from the neat edge appearance of the finished product.

The sophisticated nature of the machined ends of the stretcher bars do not allow for resizing and therefore cannot be used if the dimensions of the material to be stretched does not fall within the standard sizes currently being manufactured.

Currently available stretcher bars allow for expansion with the use of wedge inserts into the interlocking corners. These inserts, however, are often missing from the corners making it impossible to retighten the corners without them.

A lot of material is wasted due to the fact that the stretching pliers need extra material around the frame to grab onto.

It is an object of the present invention to overcome the disadvantages described and provide a canvas stretching system which can be easily used by the professional or amateur framer.

SUMMARY OF THE INVENTION

According to one embodiment of the invention there is provided a modular canvas or material framing system comprising (a) four stretcher bars mitered at the ends to be assembled into a rectangular frame for supporting a canvas or material, each stretcher bars each having a groove or ridge running lengthwise in the bar at the inner side of the bar so as to face inwardly in the assembled frame and a groove on the outer face of the stretcher running perpendicular to the adhesive strip close to the miter ends so as to face outwardly in the assembled frame, each stretcher bars each having an adhesive strip running lengthwise in the bar at the outer side of the bar so as to face outwardly in the assembled frame and extended to cover the mitered ends of the stretchers; (b) a set of U shaped fasteners applied to grooves supplied on the stretcher to keep the stretching frame in the closed position and to counter act the tension to the canvas upon closing the frame; (c) a stretching bar holding device consisting of two clamps at right angles that hold the stretcher bar ends securely in an open miter position, each having a raised platform to keep the stretchers from touching the canvas or material so that alignment can take place; (d) a set of brace members sized to engage with the grooves or ridges of the stretcher bars to reinforce the finished canvas or material frame.

Preferably corner clamps are used to assemble the stretcher bars in an initial open miter position in such a way that they are secure, square and properly placed relative to each other. The corner clamps have two channels which are generally at right angles to one another for receiving and securing two stretcher bars. The end of each channel is angled at 45 degrees, and a raised ridge is located within the channel for receiving a corresponding channel of the stretcher bar thus thereby assuring that the bars are held firmly with interference and oriented properly. The mitre of the stretcher bar includes an adhesive strip which comes into contact with the surface of the corner clamp to keep the stretcher bar temporarily secure while in the corner clamp. The means for securing the stretcher bars includes a tab located between one side of the raised ridge and one wall of the channel, which corresponds to a groove in the stretcher bar, thereby ensuring secure alignment of the stretcher bar in the corner clamp.

The canvas or material corners are cut and adhered to the open miter which contains an adhesive strip before the stretching frame is closed thus avoiding unsightly corner folds. A U shaped fastener is inserted into a groove on the stretcher bar to counter act the tension to the canvas or material and to keep the stretching frame closed.

BRIEF DESCRIPTION OF DRAWINGS

Embodiments of the invention will now be described with reference to the following drawings in which.

DESCRIPTION OF THE PREFERRED EMBODIMENT

Figure 1:
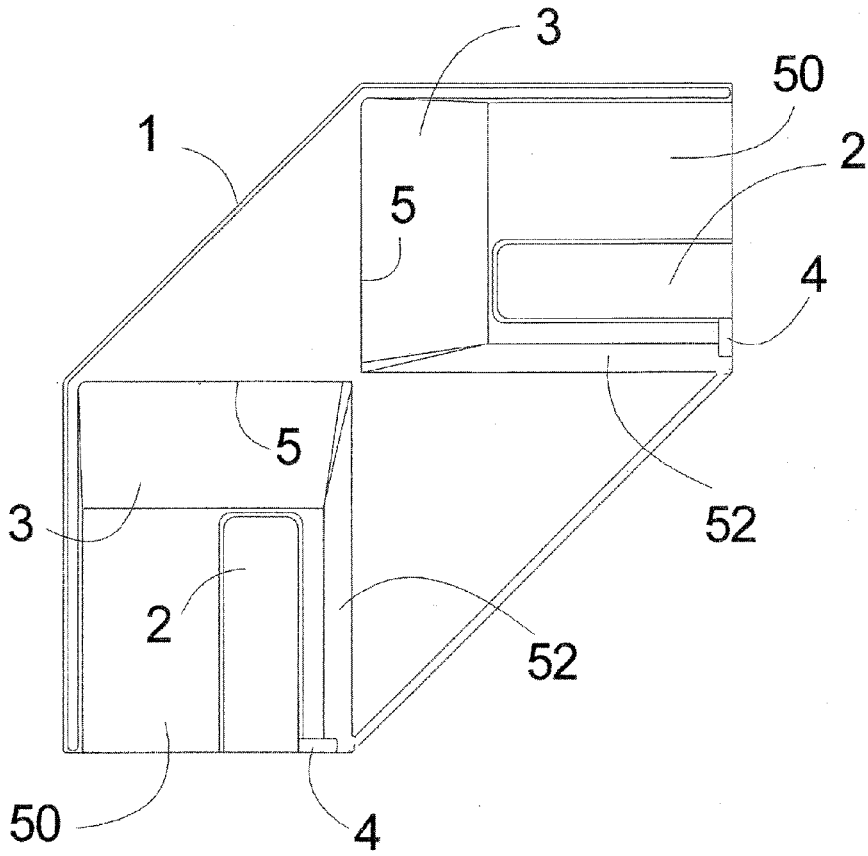
FIG. 1A is a top view of the corner clamp used for holding the stretcher bars square and secure in the open miter position according to one embodiment of the present invention.
FIG. 1B is a side view of the corner clamp of FIG. 1A.
Figure 1:
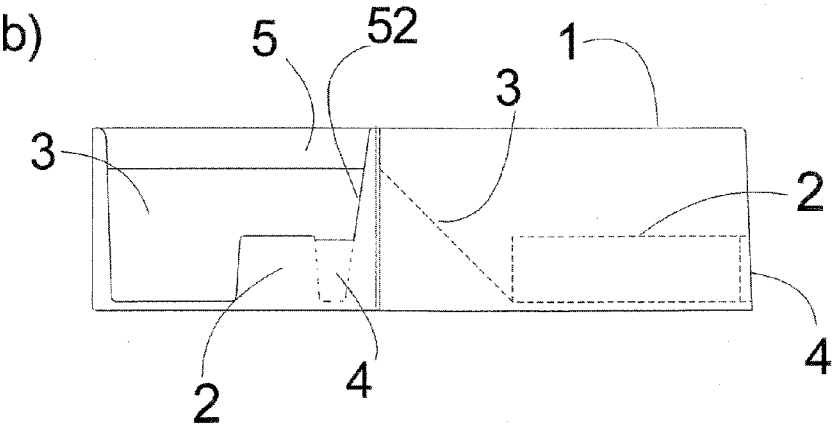
Figure 2:
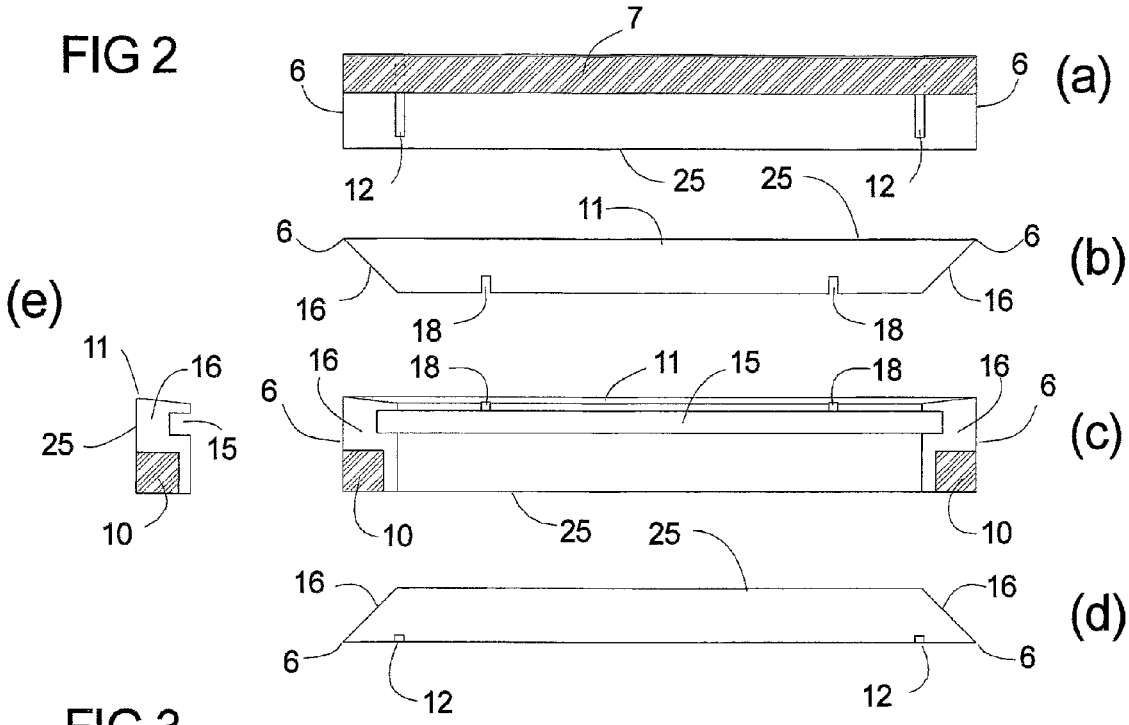
FIG. 2A is a top view of a stretcher bar.
FIG. 2B is a front view of the stretcher bar of FIG. 2A.
FIG. 2C is a bottom view of the stretcher bar of FIG. 2A.
FIG. 2D is a back view of the stretcher bar of FIG. 2A.
FIG. 2E is an end view of the stretcher bar of FIG. 2A.

Referring to the Figures, FIG. 1A is a top view of the corner clamp 1 while FIG. 1B is a front view of the corner clamp 1. Referring to FIG. 1A, each corner clamp 1 has two channels 50 which are at right angles to one another and almost meet at a point. End surface 3 of the channels 50 is angled to a point 5. A raised ridge 2 is located within the channel 50. A tab 4 is located between one side of the raised ridge 2 and one wall 52 of the channel.

Point 5 is used to locate the miter end 6 of stretcher bars 25 before the stretcher bars 25 are lowered into the corner clamps 1. Tab 4 of corner clamp 1 will fit inside locating notch 18 on stretcher bar 25 to insure proper longitudinal alignment and retention of the stretcher bar 25 in corner clamp 1. Surface 3 will adhere to the adhesive 10 on miter surface 16 to keep the stretcher bars 25 firmly in position inside the corner clamps 1. Raised ridge 2 on corner clamp 1 is designed to fit inside grove 15 on stretcher bar 25 in such a way as to interfere and keep the stretcher bar 25 secure inside the corner clamp 1. Wedge insert 2 also ensures that the stretcher bar 25 is located properly in the latitudinal position FIGS. 2*a*, 2*b*, 2*c* and 2*d* shows the features of each of the four stretcher bars 25. Each stretcher bar 25 has a miter 16 at each end. On the top of each stretcher bar 25 there are two grooves 12 which are equally spaced from the ends 6 of the stretcher bar 25. On the bottom of the stretcher bar 25, a groove 15 runs along the length of the stretcher bar 25. An adhesive strip 7 is applied to one side of the stretcher bar and wraps around the miters 16. The side on which the adhesive strip 7 is adhered will be the outer perimeter of the closed stretcher frame formed by the four stretcher bars 25.

The typical stretcher bar 25 will have a groove 15 on its' inside face to accept a brace 40 which will secure and strengthen the closed stretching frame 70. Groove 15 is also used to provide interference fit when inserted onto raised ridge 2 on corner clamp 1 to keep the stretcher 25 secure in the corner clamp 1. A bead 11 on the top of the stretcher bar 25 will keep the material 20 away from the inside edge of the stretcher bar 25 to prevent a crease on the image of the finished stretcher frame 70. Locating notches 18 are provided on the typical stretcher bar 25 to be inserted onto tabs 4 on corner clamps 1 so that the stretcher 25 are kept in the correct longitudinal position in the clamp 1 i.e. with the adhesive 10 on miter edge 16 of stretcher bar 25 touching surface 5 of clamp 1. Grooves 12 are provided to insert the "U" shaped closing fasteners 13 on the back of stretching frame 70.

Figure 3:
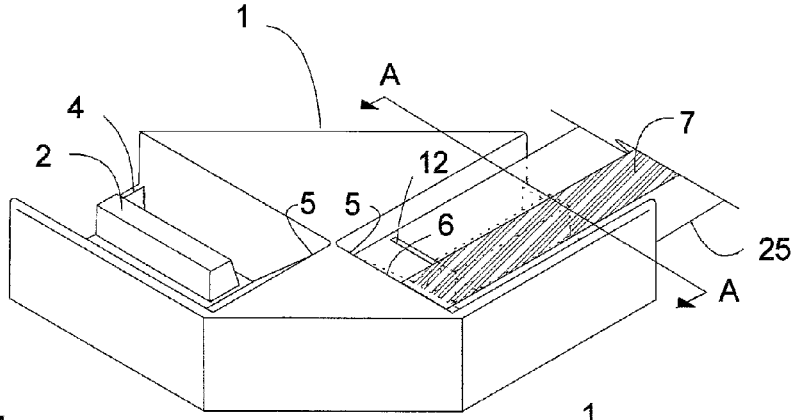
FIG. 3 is a perspective view of corner clamp showing one stretcher bar inserted.

FIG. 3 shows a perspective view of corner clamp 1 with a stretcher bar 25 inserted on one side. The end of the miter 6 of the stretcher bar 25 is placed against surface 5 on clamp 1. The Stretcher bar 25 must be lower than the top surface of the clamp in order to keep the adhesive strip 7 from touching the back of the material 20 for easy alignment.

Figure 4:
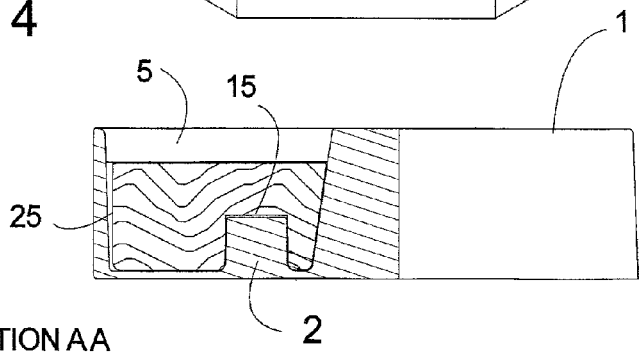
FIG. 4 is a sectional view of the corner clamp of FIG. 3 along the line A-A with a stretcher bar inserted.

FIG. 4 shows a cross section of clamp 1 with stretcher bar 25 inserted. The stretcher bar groove raised ridge 2 on clamp 1 is securely inserted in grove 15 of stretcher bar 25.

Figure 5:
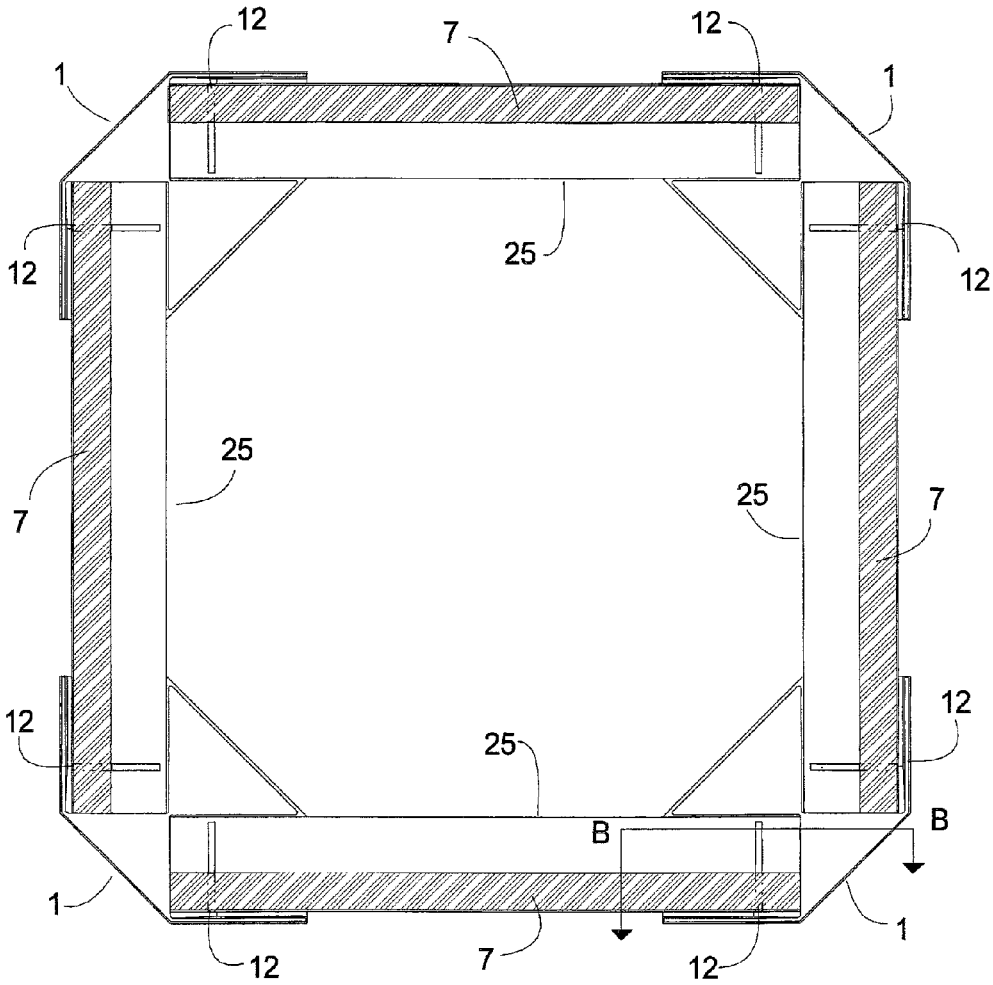
FIG. 5A is a top view of the stretcher bars inserted into corner clamps showing the adhesive strips.
FIG. 5B is a sectional side view of FIG. 5A along the line B-B, showing how the stretcher bar fits in the corner clamp.
Figure 5:
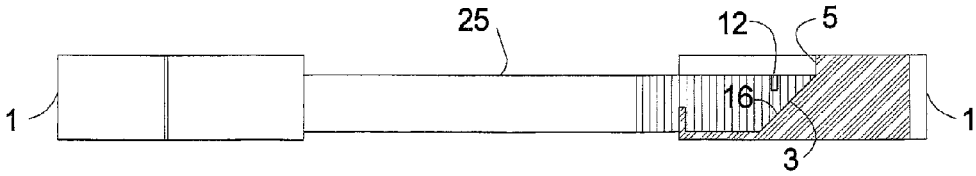

FIG. 5*a* shows the stretcher bars 25 held by the clamps 1 in the open miter position. The protective covers on the adhesive 7 on stretcher bars 25 have been removed. The stretcher bars 25 are positioned in the clamps 1 in such a way that when they are rotated into the final position the interference on the corners causes the material 20 to be stretched.

FIG. 5*b* shows the side view of the stretcher bars 25 held in the corner clamps 1. Section B-B shows how the stretcher bar 25 is held in place by the adhesive 10 on miter surface 16 against the surface 3 of corner clamp 1.

Figure 6:
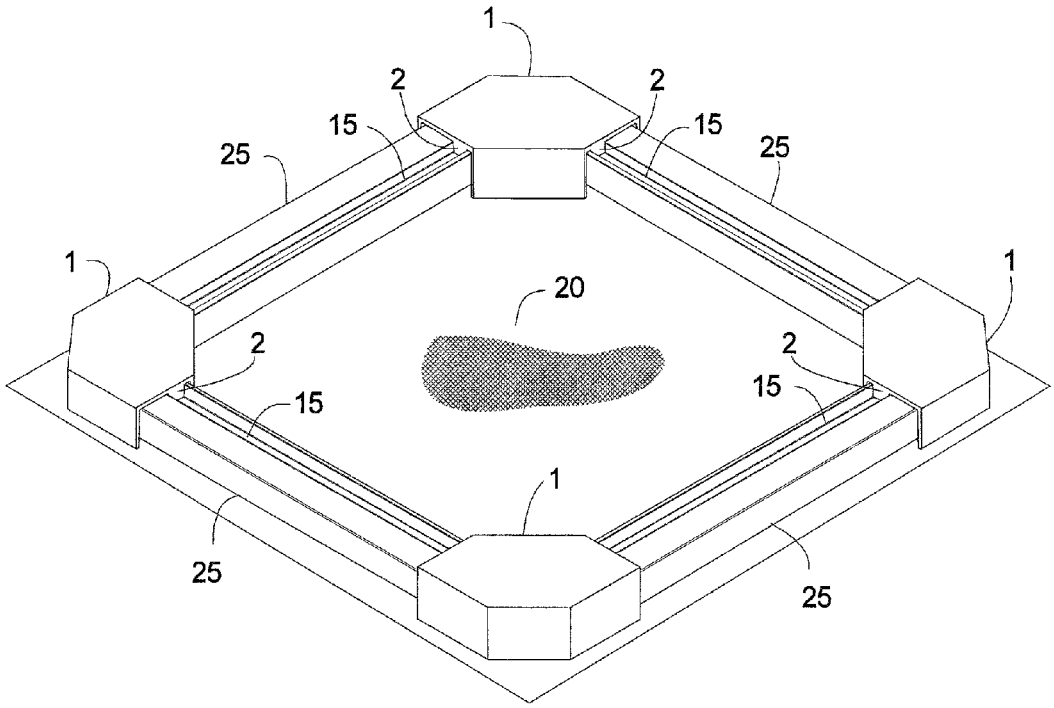
FIG. 6 is a perspective view showing the stretcher bars inserted into corner clamps and placed on the back of the material to be stretched.

FIG. 6 shows the stretcher bars 25 in place and aligned over the material 20.

Figure 7:
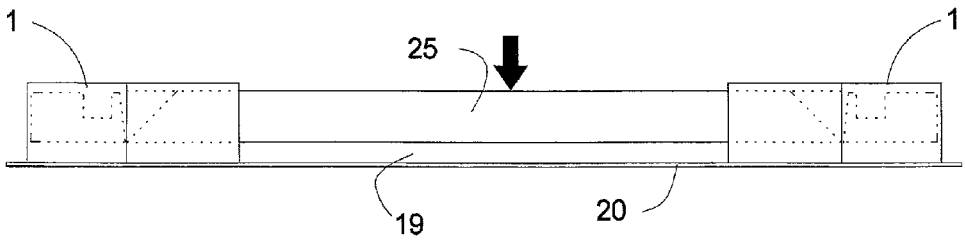
FIG. 7 is a side view of FIG. 6 showing the showing the spacing between the stretchers and the canvas, thereby allowing alignment to take place before the adhesive comes into contact.

FIG. 7 shows the space 19 between the stretcher bars 25 and the material 20. A downward push on the stretcher bars 25 will adhere them to the material 20 and release the clamps 1.

Figure 8:
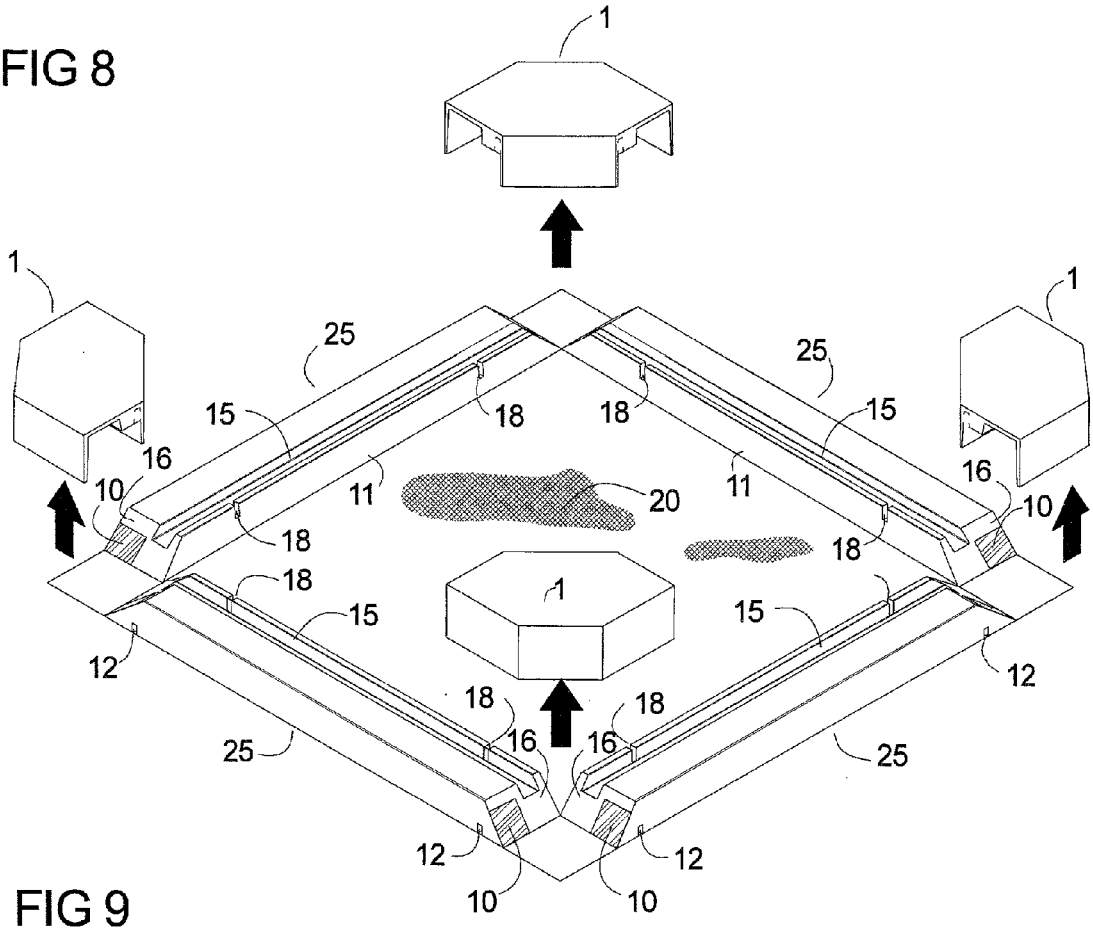
FIG. 8 is a perspective view of the stretcher frame adhered to the canvas in the open miter position with the locking corner clamps being removed.

FIG. 8 shows the stretcher bars 25 adhered to the material 20 with the corner clamps 1 removed exposing the adhesive strips 10 on the miter surfaces 16.

Figure 9:
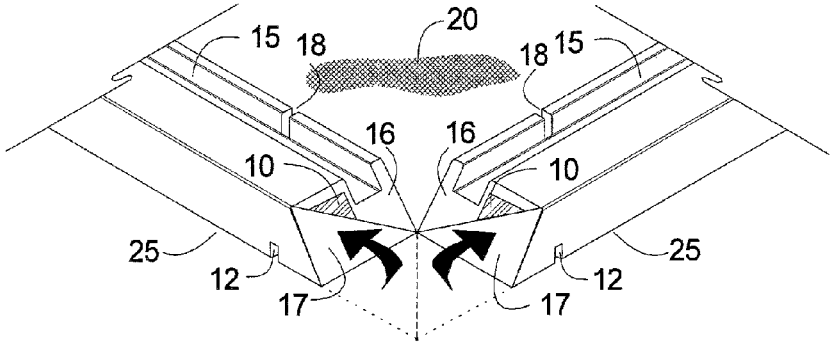
FIG. 9 is a perspective view of a corner showing the folding and adhering of the material onto the open miters of the stretching frame.

FIG. 9 shows the corners 17 of the material 20, cut folded and adhered onto the adhesive strips 10 on the open miter ends 16

Figure 10:
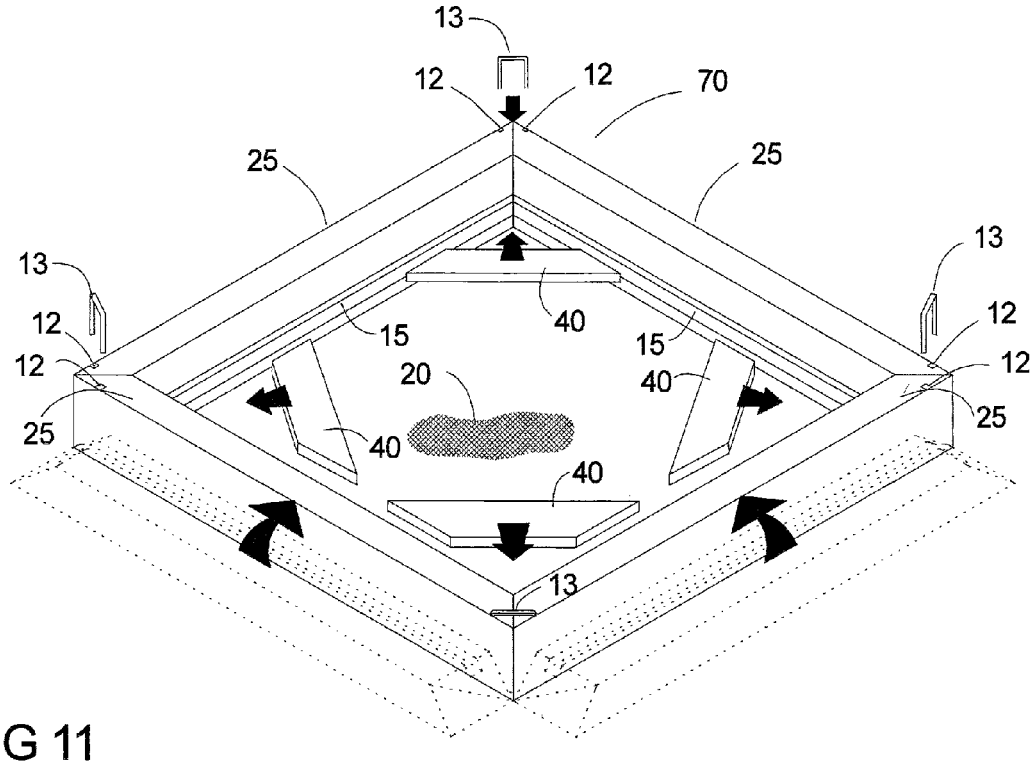
FIG. 10 is a perspective view of the top of the stretching frame with the stretcher bars now rotated into the final (miter closed) position and showing the insertion of the locking fasteners and corner braces.

In FIG. 10 the stretcher frame 70 has been rotated into the (closed miter) final position. The "U" shaped fasteners 13 are inserted into the fastener grooves 12 of the stretcher bars 25 to keep the stretching frame 70 in the closed position. The corner braces 40 are inserted into the grooves 15 of the stretcher bars 25 to add stiffness and allow for increased tension of the material 20

Figure 11:
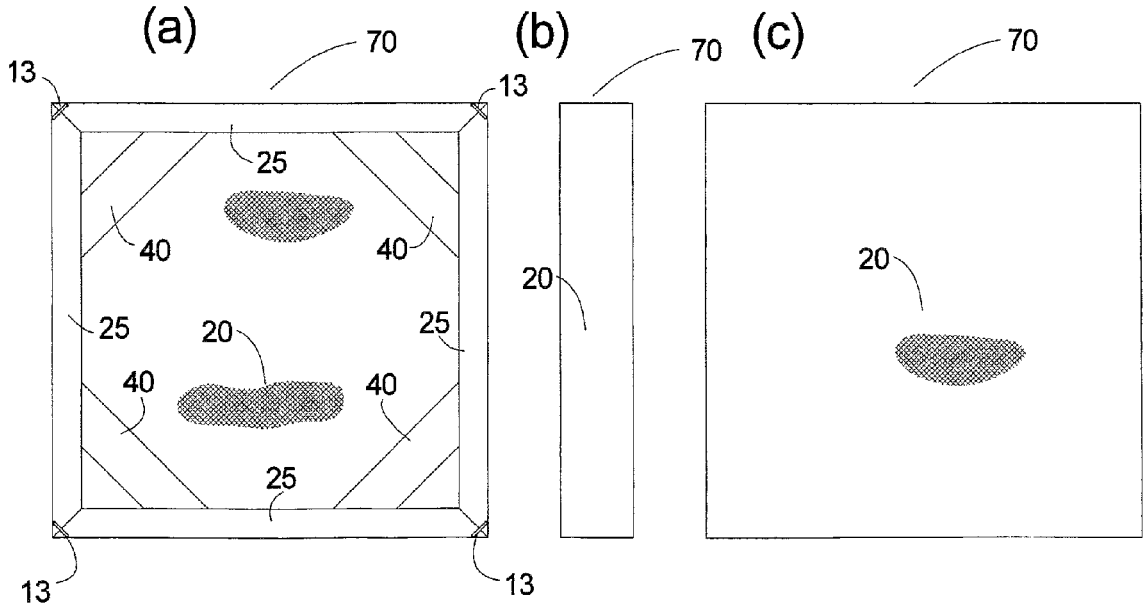
FIG. 11A is a front view of the finished stretched canvas with all corner braces and locking fasteners inserted.
FIG. 11B is a side view of the finished stretched canvas of FIG. 11A.
FIG. 11C is a back view of the finished stretched canvas of FIG. 11B.

FIG. 11 shows a front side and back view of the finished stretcher frame 70.

This invention relates to a canvas stretching system which uses four corner clamps 1 and four stretcher bars 25 to form a generally square or rectangular stretcher frame 70. In the first step, the material 20 to be stretched is placed on a flat surface such as a table (not shown), with the image (such as a digital photograph, silk screen, painting and the like) facing downwards. The protective covers are removed from the adhesive strips 7 on stretcher bars 25 and the stretcher bars 25 are inserted into corner clamps 1. The corner clamps 1 are designed to hold the stretcher bars 25 secure and the adhesive 7 away from the material 20 when assembling, thus allowing for easy alignment. When the stretcher frame 70 is in the right position over the material 20 the stretcher bars 25 are pressed down and the adhesive strip 7 on stretcher bars 25 comes into contact with material 20. The locking corner clamps 1 are removed and the corners 17 of the material 20 are cut and adhered to the adhesive 10 on the exposed miters 16. The stretcher bars 25 are rotated along their longitudinal axis into their final position. The rotation of the stretcher bars 25 and the interference of the material 17 inside the miters will stretch the material resulting in a very uniform tension along the stretching frame 70. A U-shaped fastener 13 is inserted into groove 12 on stretcher bars 25 and is used to counteract against the tension of the material 20 in order to keep the stretching frame 70 closed.

Braces 40 can be inserted into the groove 15 on the inside face opposite to the outer edges of the stretching frame 70 to add stiffness and alignment to the final product. These braces

40 can be further used to increase the tension of the material 20 by being drawn towards the corners to which they are affixed.

It will be clear to a person skilled in the art that modifications could be made to the above-identified description without departing from the scope of the invention.

Embodiments of the invention in which an exclusive property or privilege is claimed are defined as follows:

1. A modular canvas or material framing system comprising:

(a) four stretcher bars to be assembled into a rectangular frame for supporting a canvas or material, each of the stretcher bars having mitered ends, a groove or ridge running lengthwise in an inner side of the bars so as to face inwardly in the assembled frame, a groove running perpendicular in an outer side of the bars so as to face outwardly in the assembled frame, and an adhesive strip running lengthwise on the outer side of the bars and extended to cover the mitered ends;

(b) corner clamps for assembling the stretcher bars in an initial open miter position in such a way that the bars are secure, square and properly placed relative to each other, each of the clamps having two channels positioned generally at right angles to one another for receiving and securing the mitered ends of two of the stretcher bars and a raised platform to keep the stretcher bars from touching the canvas or material so that alignment can take place, each of the channels having an end that is angled at 45 degrees and a raised ridge located within the channel for receiving the groove or ridge in the inner side of the stretcher bars to assure that the bars are held firmly with interference and oriented properly;

(c) a set of U shaped fasteners applied to grooves in the outer side of the stretcher bars to counter act tension to the canvas upon moving the stretcher bars to a closed position and keep the stretcher bars in the closed position; and (d) a set of brace members sized to engage with the groove or ridge in the inner side of the bars when in the closed position to reinforce the assembled frame.

2. The modular canvas or material framing system according to claim 1, wherein the mitered ends include an adhesive strip which comes into contact with the angled end of the channels to keep the stretcher bars temporarily secure while in the corner clamp.

3. The modular canvas or material framing system according to claim 1, wherein the channels further comprise a tab located between one side of the raised ridge and one wall of the channels, which corresponds to a groove in the stretcher bars to secure alignment of the stretcher bars in the corner clamps.

4. A modular canvas or material framing system comprising:

four stretcher bars to be assembled into a rectangular frame for supporting a canvas or material, each of the stretcher bars having mitered ends, a groove or ridge running lengthwise in an inner side of the bars so as to face inwardly in the assembled frame, a groove running perpendicular in an outer side of the bars so as to face outwardly in the assembled frame, and an adhesive strip running lengthwise on the outer side of the bars and extended to cover the mitered ends; and four corner clamps for assembling the stretcher bars in an initial open miter position in such a way that the bars are secure, square and properly placed relative to each other, each of the clamps having two channels positioned generally at right angles to one another for receiving and securing the mitered ends of two of the stretcher bars and a raised platform to keep the stretcher bars from touching the canvas or material so that alignment can take place, each of the channels having an end that is angled at 45 degrees and a raised ridge located within the channel for receiving the groove or ridge in the inner side of the stretcher bars to assure that the bars are held firmly with interference and oriented properly.

5. The modular canvas or material framing system according to claim 4, wherein the mitered ends include an adhesive strip which comes into contact with the angled end of the channels to keep the stretcher bars temporarily secure while in the corner clamp.

6. The modular canvas or material framing system according to claim 4, wherein the channels further comprise a tab located between one side of the raised ridge and one wall of the channels, which corresponds to a groove in the stretcher bars to secure alignment of the stretcher bars in the corner clamps.

* * * * *